US006968765B2

(12) United States Patent
King

(10) Patent No.: US 6,968,765 B2
(45) Date of Patent: Nov. 29, 2005

(54) CUTTING HEAD FOR CUTTING A FOOD PRODUCT

(75) Inventor: Daniel W. King, Valparaiso, IN (US)

(73) Assignee: Urschel Laboratories Inc., Valparaiso, IN (US)

( * ) Notice: Subject to any disclaimer, the term of this patent is extended or adjusted under 35 U.S.C. 154(b) by 0 days.

(21) Appl. No.: 10/825,159

(22) Filed: Apr. 16, 2004

(65) Prior Publication Data

US 2004/0237747 A1 Dec. 2, 2004

Related U.S. Application Data

(60) Provisional application No. 60/473,888, filed on May 29, 2003.

(51) Int. Cl.[7] ..... B26D 1/03
(52) U.S. Cl. ..... 83/403; 83/699.51; 83/932
(58) Field of Search ..... 83/403, 699.51, 83/932; 99/589

(56) References Cited

U.S. PATENT DOCUMENTS 1,474,797 A * 11/1923 Spicer ..... 83/403
2,436,410 A * 2/1948 Urschel et al. ..... 83/404.3
4,055,099 A * 10/1977 Mitsubayashi ..... 83/403
4,511,586 A 4/1985 Fitzwater et al.
4,588,135 A * 5/1986 Himi ..... 241/84
4,767,068 A * 8/1988 Ando ..... 241/84
5,249,494 A * 10/1993 Borvitz ..... 83/302
5,694,824 A 12/1997 Jacko et al.
6,148,709 A 11/2000 Bucks
6,536,691 B2 * 3/2003 Prewitt et al. ..... 241/86.1
2002/0029673 A1 * 3/2002 Arrasmith ..... 83/145

OTHER PUBLICATIONS

Model CC, Urschel Laboratories, pp. 2, May 7, 2003.

* cited by examiner

*Primary Examiner*—Kenneth E. Peterson
(74) *Attorney, Agent, or Firm*—Bacon & Thomas, PLLC

(57) ABSTRACT

An improved cutting head for a food product on a slicing machine including upper and lower mounting rings, a plurality of cutter support segments connected to the mounting rings, a cutting blade attached to a front edge portion of each cutter support segment, and opposed first and second pivot pins extending from upper and lower portions of the cutter support segment and through the upper and lower mounting rings. Each of the pivot pins are positioned at a location closely adjacent to a forward edge of the cutter support segment and substantially near a cutting edge of the cutting blade.

16 Claims, 6 Drawing Sheets

CUTTING HEAD FOR CUTTING A FOOD PRODUCT

This application claims the benefit of provisional application No. 60/473,888 filed May 29, 2003.

BACKGROUND OF THE INVENTION

1. Field of the Invention

The present invention relates to an improved cutting head for a food product slicing machine.

2. Discussion of Related Art

Machines for slicing or cutting food products, such as vegetables, nuts, and fruit, are well known in the art. A known slicing apparatus is described in U.S. Pat. No. 5,694,824 and comprises a main frame, a drive motor, a stationary annular cutting head fixedly attached to the main frame and having a series of circumferentially spaced cutter support segments each with a cutting blade having a cutting edge mounted thereon, and a rotatable impeller surrounded by the cutting head and connected to a drive motor for rotation within the cutting head. The cutting head and the impeller are configured so that the impeller directs a food product outwardly against the cutting blades when the impeller is rotated within the cutting head.

The known cutting head further comprises a plurality of cutter support segments that have upper portions connected to an upper mounting ring and lower portions that are secured to a lower mounting ring. The cutting blade is attached to the forward edge portion of each cutter support segment so as to define a gate opening between the cutting edge of the blade and an adjacent cutter support segment, and clamp members are mounted to the cutter support segments to secure the cutting blade to the cutter support segment. Each of the cutter support segments includes normally extending opposed pivot pins that define a pivot axis and engage the upper and lower mounting rings. The pivot pins are generally located between a center distance of the cutter support segment and a rear edge of the cutting blade. This is due to the basic configuration of the cutter support segments, the clamp members and the blade. The gate opening is adjusted by at least one adjustment member configured to engage a pin attached near a rear edge portion of the cutter support segment and threaded into the upper and lower mounting rings generally along a line defined by their radii. The adjustment member is arranged to adjust the gate opening by being rotated to advance or withdraw the member relative to the upper and lower mounting rings, thereby urging the cutter support segment to pivot about the pivot axis to adjust the width of the gate opening and, consequently, adjust the thickness of the sliced food product.

In food processing, it is very important in cutting the food product into slices or shreds that the resultant food product has a uniform thickness. Such thickness uniformity facilitates further processing by yielding a maximum amount of usable food product with a minimum amount of waste. Furthermore, thickness uniformity enables uniform frying, roasting or melting of the sliced product, and produces an attractive food product to the consumer. Controlling the consistency of the thickness of the food products with the known cutting head requires accurate adjustment of the gate openings and coordination with the impeller disposed within the cutting head when mounted on the cuffing machine.

It has been found with the known cutting head that it is difficult and time consuming to precisely adjust the gate openings to a desired width, and thereby produce slices or shreds of uniform thickness. It follows that it is also difficult to achieve a uniform gate opening between each cutting blade and an adjacent rear edge of a cutter support segment, and it has been found that the known cutting head will yield an inconsistent slice or shred thickness about the circular array of cutter support segments for a given cutting operation. The problem associated with the known cutting heads stems in large pat from the location of the pivot pins relative to the cutting edge of the cutting blade, and with the configuration of the known cutter support segments, the pivot pin locations could not be brought closer to the cutting edge of the cutting blade to improve the geometry of the adjustment system.

Another drawback with the known cutting head is that a substantial portion of the blade intrudes within the central portion of the cutting head when the forward edge portion of the cutter support segment is pivoted inwardly towards the center of the cutting head. As a result, different sized impellers are required according to the size of the gate opening since the cutting blade that extends into the central portion of the cutting head reduces the effective diameter of the cutting head. This requires an operator of the machine to maintain a supply of different sized impellers, and further causes additional down time of cutting operations due to the need for impeller replacement.

In cutting food products, it has been found that in some instances, it is desirable to provide a cutting head with cutter support segments that have a more compact size and configuration including a shorter length. The compact size of the cutter support segments will permit a cutting apparatus to accommodate more cutter support segments which will result in greater throughput of the cutting operation. With more cutter support segments, it follows that more slices or shreds of the food product are achieved per revolution of the impeller, and this results in less time that the food product will be in contact with the cutter support segment before it is sliced or shredded. This may lead to less smearing of certain soft food products, such as cheeses, which are difficult to slice or shred due to their inherent soft and sticky nature. Furthermore, it has been shown that by providing a shorter cutter support segment under certain conditions, the horsepower requirement to cut a certain amount of food product is reduced.

SUMMARY OF THE INVENTION

An improved cutting head for cutting a food product is disclosed wherein the cutting head includes pivot pins that extend opposed from one another from upper and lower portions of each cutter support segments at a location closely adjacent to a forward edge of the cutter support segment and substantially near a cutting edge of a cutting blade mounted on the cutter support segment. The pivot pins define a pivot axis and extend through first and second mounting rings connected to the upper and lower portions, respectively, of the cutter support segments. The cutter support segments are configured so that the clamping members and the cutting blades are generally retained within a forward edge portion thereof, wherein the cutting edge of the cutting blades extends a short distance from the forward edge of the cutter support segments relative to their width. The pivot pins are generally located along the forward edge portion of the cutter support segment between lines defined by the cutting edge and an opposed rear edge of the cutting blade. The improved cutting head also includes an improved adjustment mechanism that is arranged at an oblique angle relative to the radius of the upper and lower mounting rings and configured to engage a pin attached at the rear edge portion of the cutter support segments. The upper and lower rings include a plurality of recesses that are configured and arranged to accept a portion of the adjustment mechanism while retaining the pin, and further include a plurality of arcuate slots defined therethrough that are each configured to accept a fastener that retains the upper and lower rings to the cutter support segments.

According to the principles of the present invention, these features of the cutting head of the present invention improve the precision of the adjustability of the gate opening since the pivot pins are positioned closely adjacent the forward edge of the cutter support segments, and substantially near the cutting edge of the cutting blades. This results in reducing the excursion of the cutting edge to the adjacent cutter support segment relative to adjustment by the adjustment mechanism over the known cutting head. Furthermore, the portion of the cutting blade extending into the central portion of the cutting head is minimized. The positioning of the clamping members, the adjustment mechanism, the configuration of the recesses and the arcuate slots of the mounting rings all contribute to the improve adjustment of the gate openings. It will also be appreciated that the features of the invention provide a more compact and stable cutter support segment than the known cutter support segments, and therefore enable the cutting head to accommodate more cutter support segments than the known cutting head.

DETAILED DESCRIPTION OF THE PREFERRED EMBODIMENTS

Figure 1:
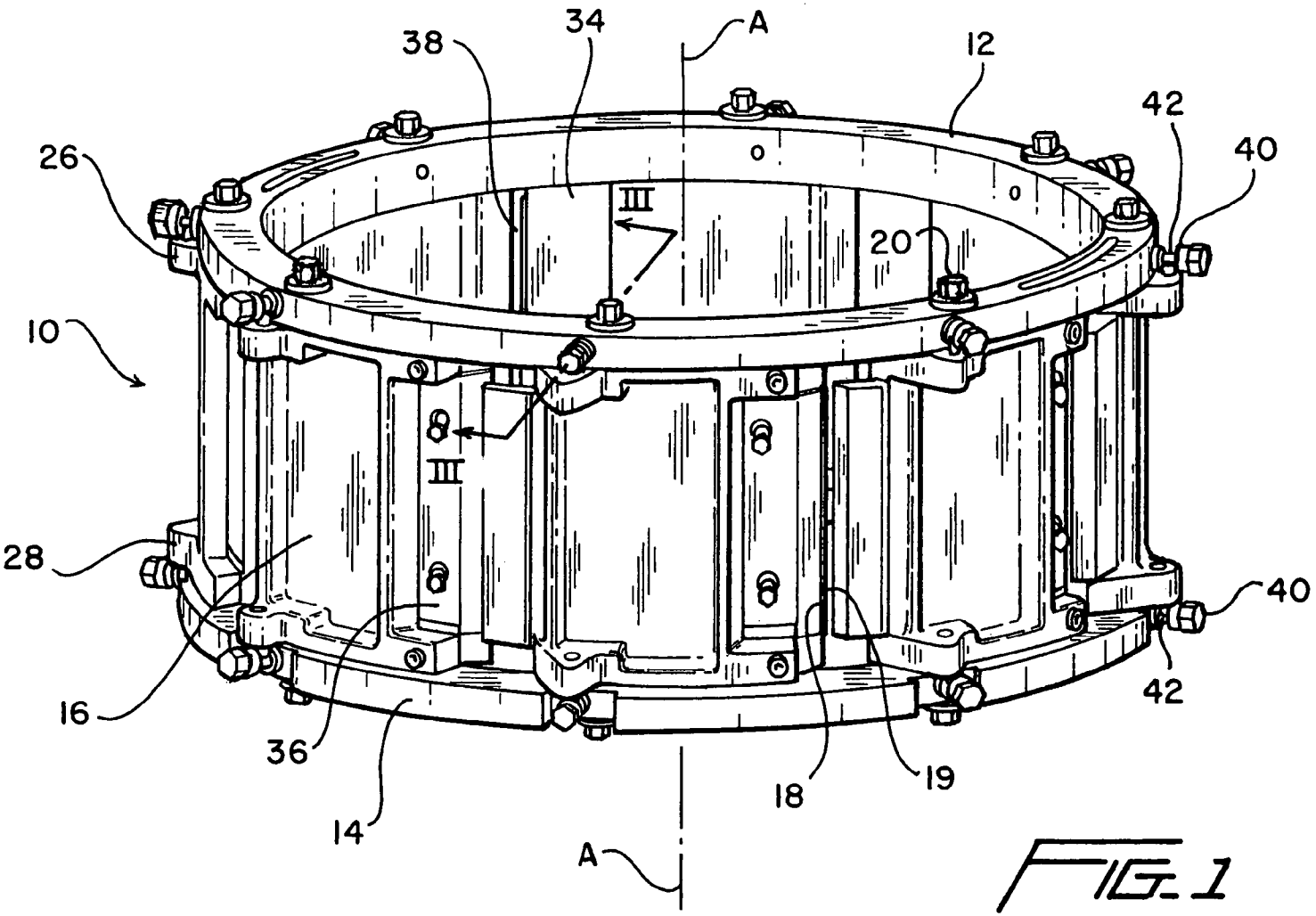
FIG. 1 (PRIOR ART)
FIG. 1 is a perspective view of a known cutting head.

With reference now to the drawings, FIG. 1 illustrates a cutting head 10 for a food product cutting machine that is well known in the art and is at least in part further described in U.S. Pat. No. 5,694,824, the entirety of which is incorporated herein by reference. The cutting head 10 includes upper and lower mounting rings 12, 14 between which are mounted a plurality of cutter support segments 16, each having a cutting blade 18 mounted thereon. As can be seen, the cutter support segments 16 are arranged in a generally circular, annular array about axis A—A, and have inner and outer sides relative to the interior and exterior of the circular, annular array. The inner surfaces of the cutter support segments 16 define a central portion of the cutting head 10 that includes a circumference defined by the circular array of cutter support segments 16. Each of the cutter support segments 16 are attached to both the upper and lower mounting rings 12, 14 by a plurality of fastening devices 20 that extend through oversized holes in the upper and lower mounting rings 12, 14 and are received by the cutter support segments 16. The cutter support segments define a gate opening 38 between adjacent cutter support segments 16 that defines the thickness of a sliced food product.

Figure 2:
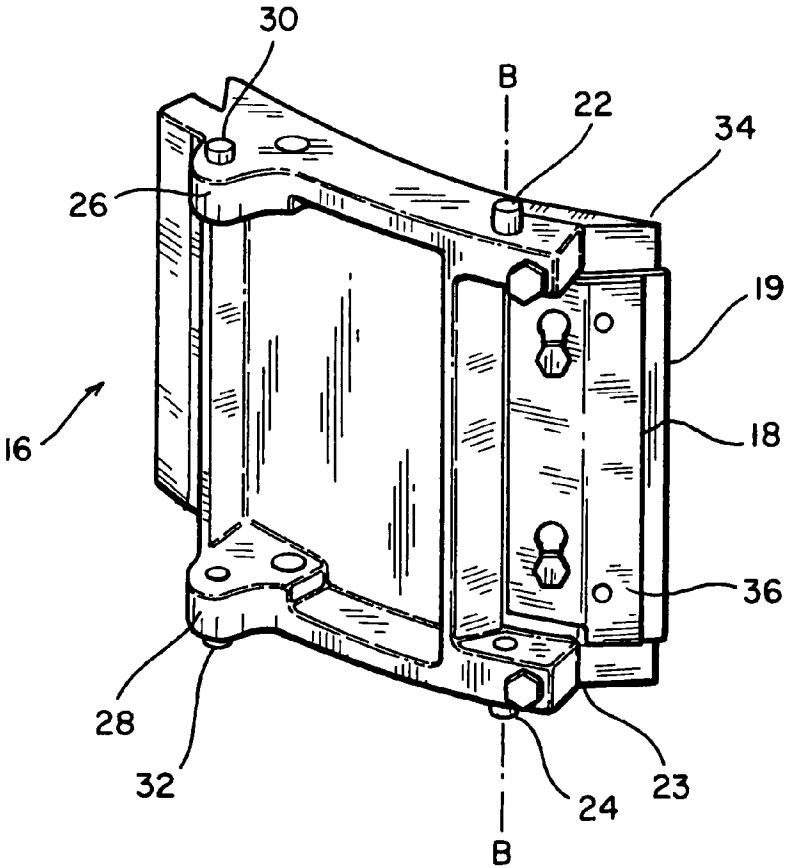
FIG. 2 (PRIOR ART)
FIG. 2 is a perspective view of a known cutter support segment in FIG. 1 of the known cutting head.

The known cutter support segment 16 is illustrated in FIG. 2, and as can be seen, each cutter support segment 16 includes an upper pivot pin 22 extending normally from a top portion of the cutter support segment 16 near a forward edge portion thereof and a lower pivot pin 24 axially aligned with the upper pivot pin 22 and extending normally from a bottom portion of the cutter support segment 16. The upper and lower pivot pins 22, 24 are received by the upper and lower mounting rings 12, 14 respectively (as shown in FIG. 1), and permit the cutter support segment 16 to pivot about axis B—B relative to the upper and lower mounting rings 12, 14. The cutting blade 18 is retained by inner and outer clamping members 34, 36 located at and extending from the forward edge portion of the cutter support segment 16. The cutter support segment 16 also includes a rear edge portion and defines upper and lower flanges 26, 28 that generally extend parallel from the top and bottom portions of the cutter support segment 16 on an outer side of the cutter support segment 16. Each of the upper and lower flanges 26, 28 carries a corresponding adjustment pin 30, 32 that extends normally therefrom.

Figure 3:
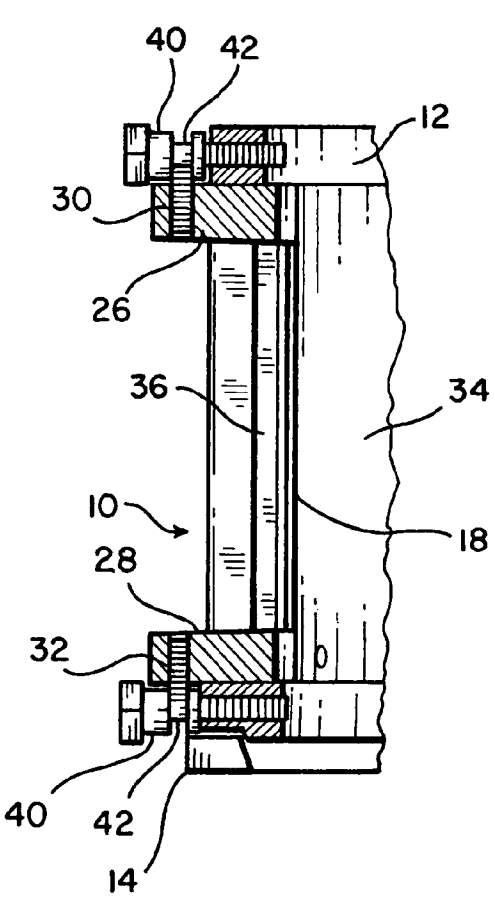
FIG. 3 (PRIOR ART)
FIG. 3 is a sectional view taken along line III—III in FIG. 1.

As shown in FIG. 3, the known cutter support segment 16 includes an adjustment mechanism for adjusting the positions of the cutter support segments so as to adjust the width of the gate opening 38 in FIG. 1. The adjustment mechanism includes an adjustment member 40 provided for each of the adjustment pins 30, 32 and received by respective mounting rings 12, 14 with its axis radially aligned with a radius of the mounting rings 12, 14. The adjustment member 40 includes an annular positioning surface 42 that is configured to receive a portion of a corresponding adjustment pin 30, 32. The adjustment member 40 may be adjusted to thereby urge the rear edge (gate) of the cutter support segment 16 either inwardly towards the interior of the cutting head 10 or outwardly towards the exterior of the cutting head 10 to either enlarge or reduce the gate opening 38. Due to pivoting action of this cutter support segment 16, the cutting blade 18 will be adjusted opposite the rear edge of the cutter support segment 16.

Figure 4:
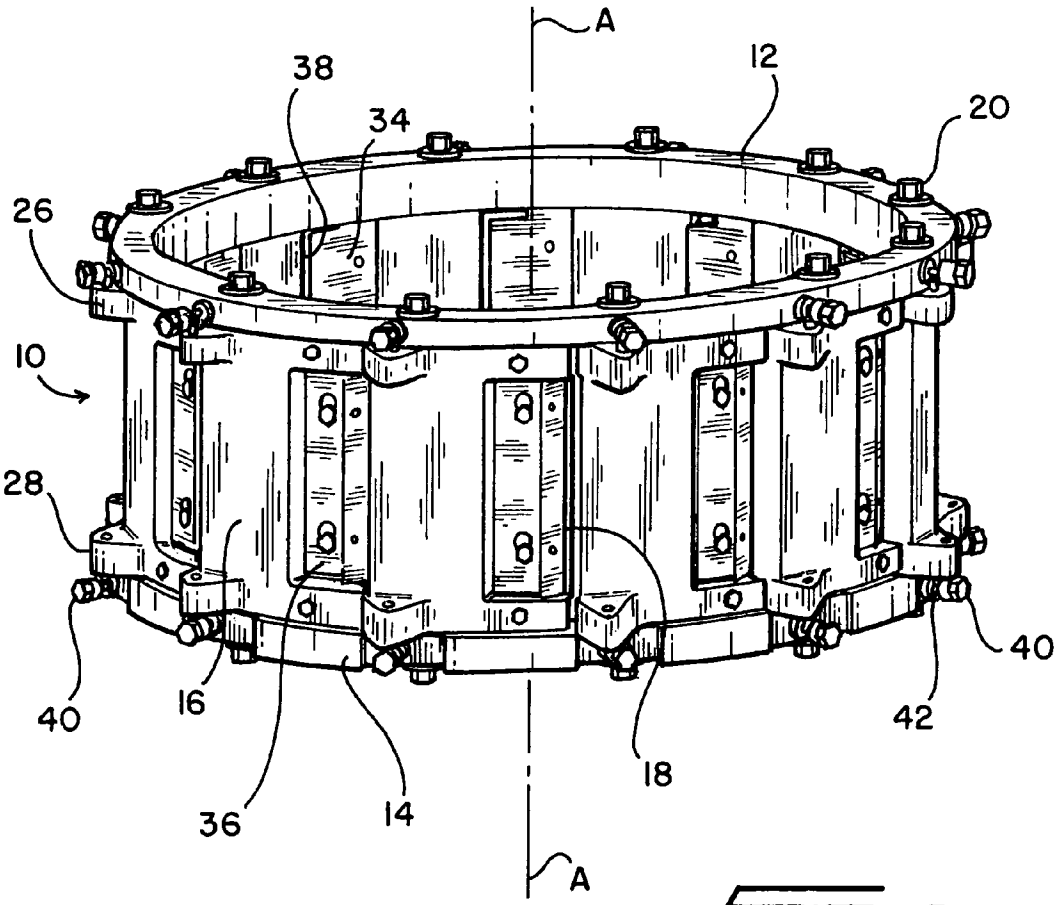
FIG. 4 is a perspective view of a cutting head for a food product slicing machine according to the present invention.

A preferred embodiment of a cutting head 10 according to the invention is illustrated in FIG. 4. As in the known cutting head, the cutting head 10 of the invention includes upper and lower mounting rings 12, 14 and a plurality of cutter support segments 16 including generally arcuate inner and outer surfaces disposed generally in a circular array about central axis A—A. Each cutter support segment includes an upper portion attached to the upper mounting ring 12, a forward edge portion, a rear edge portion and a lower portion attached to the lower mounting ring 14. A cutting blade 18 having a cutting edge 19 is attached to the forward edge portion of each cutter support segment by clamping members 34, 36.

Figure 5:
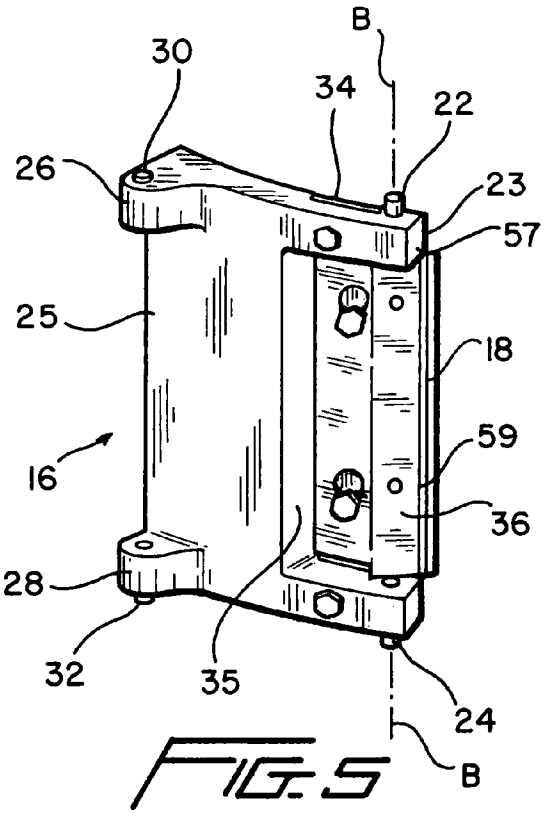
FIG. 5 is a perspective view of a cutter support segment in FIG. 4 of the cutting head of the present invention.

As best illustrated in FIG. 5, the cutter support segment 16 of the invention preferably includes opposed upper and lower pivot pins 22, 24 with axis B—B and normally extending from the upper and lower portions of the cutter support segment 16 at a location closely adjacent to the forward edge 23 of the cutter support segment 16. The upper and lower pivot pins 22, 24 extend through the upper and lower mounting rings 12, 14 and permit the cutter support segment 16 to pivot about pivot axis B—B to enlarge or reduce the gate opening 38 between the cutting edge 19 and an adjacent cutter support segment. The cutter support segment 16 includes upper and lower flanges 26, 28 that generally extend parallel from the top and bottom portions of the cutter support segment 16 on an outer side of the cutter support segment 16. Each of the upper and lower flanges 26, 28 carries a respective upper or lower adjustment pin 30, 32 that extends normally therefrom.

Figure 6:
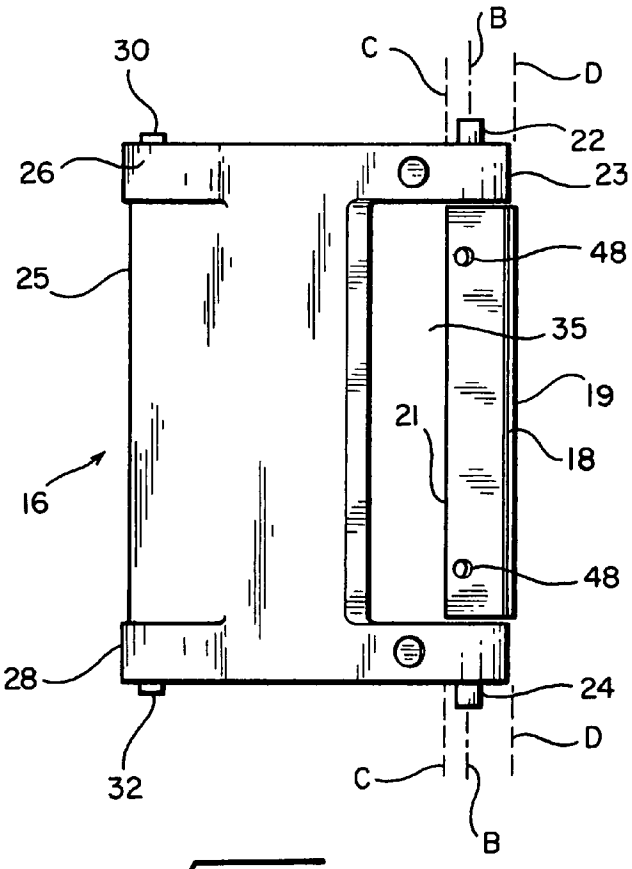
FIG. 6 is a schematic elevational view of the cutter support segment in FIG. 5 without the clamping members.

In the preferred embodiment shown in FIG. 6, the cutter support segment 16 is shown with the cutting blade 18 located relative to the cutter support segment 16 without clamping members 34, 36. The upper and lower pivot pins 22, 24 extend from a portion of the forward edge portion of the cutter support segment 16 that is between a line C—C defined by rear edge 21 of the cutting blade 18 and a line D—D defined by the cutting edge 19. In this embodiment, the preferred distance between pivot axis B—B and the rear edge 25 of the cutter support segment 16 is within the range of 7.0 to 8.5 times the distance between pivot axis B—B and line D—D of the cutting edge 19 of the cutting blade 18. It will be noted that in an alternative embodiment, the location of pivot axis B—B is colinear with line D—D, such that as the pivot pins 22, 24 are placed closer to line D—D, the aforesaid range approaches infinity. Also, as shown in FIG. 5 in the preferred embodiment, the pivot pins 22, 24 are centered about the width of the cutter support segment 16. It will be noted, however, that the cutter support segment 16 is not limited to receiving the pivot pins 22, 24 centered about its width, and such pins 22, 24 may be located at different locations along the width of the cutter support segment 16 according to a desired location of the pivot axis B—B.

The cutter support segments 16 of the invention are pivotally mounted on the upper and lower mounting rings 12, 14 about pivot axis B—B and pivotally movable between a range of motion defined by a first position wherein the cutting edge 19 is positioned closely adjacent a rear edge portion of an adjacent cutter support segment and generally concentric with the upper and lower mounting rings 12, 14, and to at least a second position wherein the cutting edge 19 is positioned at an acute angle relative to the radii of the upper and lower mounting rings 12, 14 and projecting inwardly towards the central portion of the cutting head 10. As a result of the placement of the pivot pins 22, 24, the cutting edge 19 only extends a short distance inwardly towards the circumference of the central portion of the circular array of the cutter support segments 16 so as to not reduce the effective inner diameter of the cutting head 10. The distance that the cutting edge 19 extends into the central portion is dependent upon the placement of the pivot pins 22, 24 relative to the cutting edge 19. As noted above, ideally, it is most preferred that the pivot pins 22, 24 be located as near as possible to the cutting edge 19.

In a preferred embodiment, it will be noted that the cutting edge 19 only extends beyond the forward edge 23 of the cutter support segment 16 a short distance in a range of 5–20% of the overall width of the cutting blade 18 defined between the cutting and rear edges 19, 21.

Figure 7:
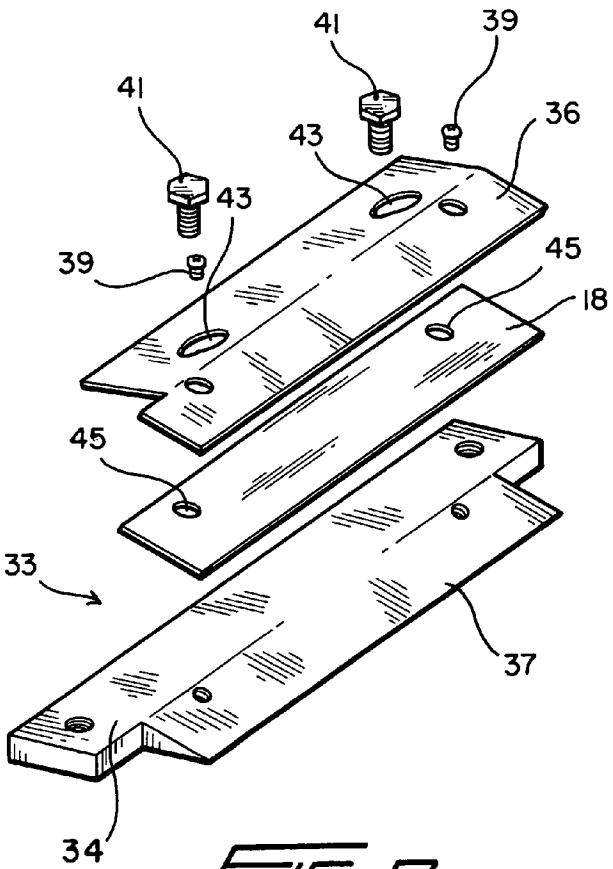
FIG. 7 is an exploded view of clamping members and a first embodiment of a cutting blade according to the present invention.

FIGS. 5–7 illustrate the inner and outer clamping members 34, 36 on which the cutting blade 18 is mounted. In FIG. 7, the cutting blade 18 is held against bevel surface 37 formed on the inner clamping member 34 and attached to the inner and outer clamping members by locating studs 39 which extend through openings 45 of the cutting blade 18 to properly locate the blade relative to the clamping members 34, 36. The outer clamping member 36 is secured to the inner clamping member 34 by fasteners 41 by way of keyhole-shaped slots 43 which enable the removal of the outer clamping member 36 by merely loosening the fasteners 41 and moving the outer clamping member 36 such that heads of the fasteners 41 are aligned with the larger opening potion of the keyhole shaped slots 43 and then removing the outer clamping member 36.

In the preferred embodiment shown in FIG. 5, the clamping members 34, 36 are generally mounted within a recess 35 defined at the forward edge portion of the cutter support segment 16. The recess 35 enables the clamping members 34, 36 to be generally contained within the cutter support segment 16 so as to not substantially extend therefrom. For example, the forward edge 59 of the outer clamping member 36 may not extend beyond the forward edge 23 of the cutter support segment 16, and the forward edge 57 of the inner clamping member 34 extends a short distance beyond the forward edge 23 of the cutter support segment 16 but less than the distance between the cutting edge 19 and the forward edge 23 of the cutter support segment 16. Accordingly, by providing the recess 35, the overall length of the cutter support segment 16 is reduced, thereby permitting the cutting head 10 to accommodate more cutter support segments 16 than in the known cutting head 10 wherein a substantial portion of the clamping members 34, 36 extend from the forward edges 23 of the cutter support segments 16.

Figure 8:
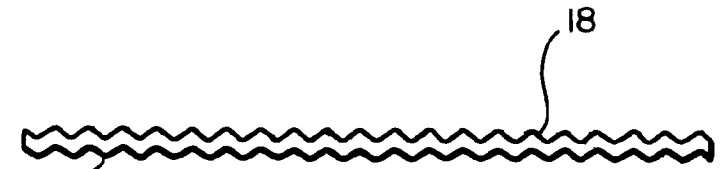
FIG. 8 is a front view of a first variation of the cutting blade of FIG. 7 having a series of curves along the cutting edge.

As described thus far, the cutting blade 18 described in FIGS. 6 and 7 has a straight, linear cutting edge 19 and an opposed rear edge 21. Alternatively, the cutting edge 19 may be convexly or concavely curved, or may be modified to form food product slices having "wavy" opposite surfaces or "V-shaped" grooves in opposite surfaces. A first variation is shown in FIG. 8 having the identical configuration of the knife illustrated in FIGS. 6 and 7, except for the cutting edge 47 having a sinusoidal or "wavy" configuration extending along the length of the cutting edge comprising a series of curves having opposite curvatures. Blades of this configuration will form food product slices having "wavy" or scalloped opposite major surfaces.

Figure 9:
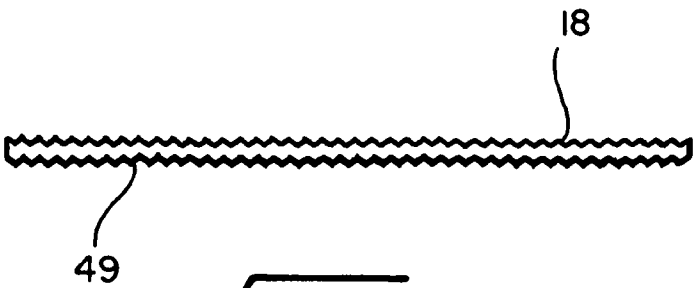
FIG. 9 is a front view of a second variation of the cutting blade having a series of V-shapes along the cutting edge.

A second variation of the blade is shown in FIG. 9, wherein the cutting edge 49 comprises a series of "V's" along the length of the cutting edge to form food product slices having V-shaped grooves in opposite major surfaces. When the cutting blades 18 are connected to the cutter support segments 16, the curves of the cutting edge 47, or the "V's" of cutting edge 49 may be radially aligned with those of adjacent blades for shaped food slices of desired shapes. The cutting edges of alternative blades may also be formed or located such that the curves or "V's" of every other knife is out of radial alignment (i.e., out of phase with) with adjacent knives if it is desired to form a shredded food product having an oval or crescent-shaped cross section if the "wavy" cutting edge 47 is used, or a square or rectangle-shaped cross section if the V-shaped cutting edge 49 is used.

It will be noted that the cutter support segments 16 can be formed or positioned to have alternating heights corresponding to a ½ offset of the distance between each peak or periodic spacing of the curves or "V's" of the cutting edges 47, 49. Suitable shims may be used to offset each cutter support segment relative to adjacent cutter support segments or the cutter support segments may be formed to permit their being suitably offset from adjacent cutter support segments.

While the above-described cutting blade variations have been described, the cutting head of the present invention is not limited to straight, curved or V-shaped blades. In fact, the cutting head of the invention may be configured to accommodate any form of a cutting blade appropriate for food slicing operations.

Figure 10:
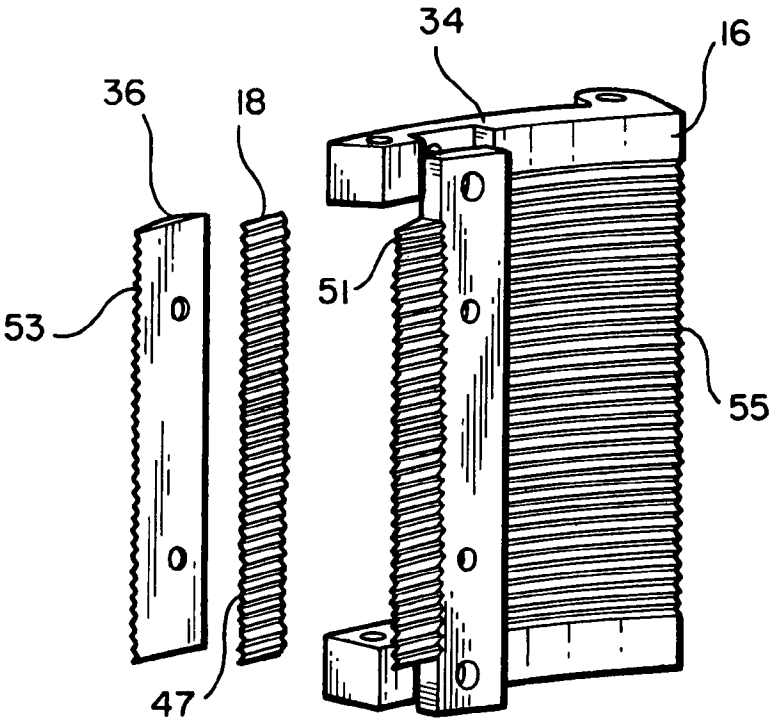
FIG. 10 is an exploded view of a variation of the cutter support segment of FIG. 5.

In an alternate embodiment shown in FIG. 10, the forward end portions 51, 53 of the clamping members 34, 36 and the inner wall 55 of the cutter support segment 16 may include a profile corresponding to one of the above-described variations of the configurations of the cutting blade 18. While in this embodiment the profiles of the clamping members and the cutter support segment are shown corresponding to the V-shaped cutting edge 49, it will be understood that the clamping members 34, 36 and the cutter support segment 16 may include a profile corresponding to the curved shaped cutting edge 47 if the cutting head is adapted for such type of processing operations.

Figure 11:
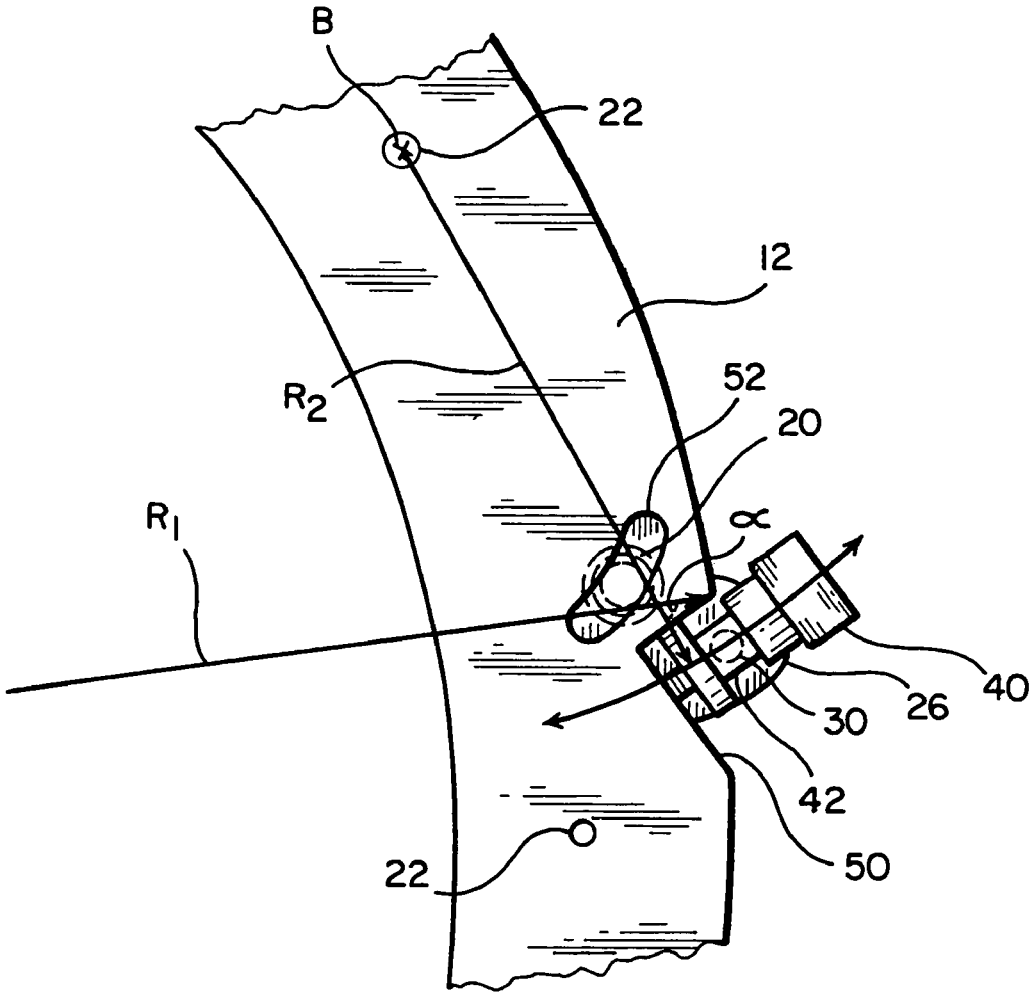
FIG. 11 is a sectional plan view illustrating a mounting ring connected to an adjustment member and a cutter support segment.

As illustrated in FIG. 11, the adjustment mechanism for adjusting the positions of the cutter support segments 16 preferably comprises an adjustment member 40 having an annular positioning surface 42 that is configured to receive a portion of a corresponding adjustment pin 30, 32 extending normally from the flanges 26, 28. The adjustment member 40 is arranged to engage the upper mounting ring 12 at an angle $\propto$ oblique to the radius R1 of the upper mounting ring 12 and includes a portion that extends perpendicularly therefrom. The upper mounting ring 12 includes a recess 50 along an outer periphery thereof, and the recess 50 is arranged at the oblique angle $\propto$ of the adjustment member 40 and configured to receive at least a portion of the adjustment pin 30 and adjustment member 40. The oblique angle $\propto$ of the adjustment member 40 is defined along a chord of a radius that the adjustment pin defines throughout the range of motion of the cutter support segment 16 as it is pivoted about pivot axis B—B and is dependent upon the radius R2 of the cutter support segment defined from the pivot pin 22 to the adjustment pin 30. In the preferred embodiment, a corresponding adjustment member 40 is configured to connect to the lower mounting ring equally as well as the adjustment member 40 to the upper mounting ring 12.

The recess 50 is provided to allow the adjustment member 40 to have a flat surface to contact, and further to permit the adjustment pins 30, 32 to be located closer to a center portion of the cutter support segments 16. By positioning the adjustment pins 30, 32 closer to the center portion of the cutter support segments 16, the overall width and height of the cutter support segments 16 can be reduced, and further there is a reduction in the amount of material a cutter support segment 16 requires for fabrication as well as overall weight of the cutting head.

When desired to adjust the width of the gate opening 38, the adjustment member 40 is rotated in a corresponding direction relative to the corresponding mounting ring upon which the adjustment member 40 is received. While rotating the adjustment member 40, the annular positioning surface 42 receives one of the adjustment pins 30, 32 thereby urging the cutter support segment 16 to pivot about pivot axis B—B. Quite obviously, other configurations of adjustment members having various positioning surfaces may be utilized without exceeding the scope of this invention.

In the cutting head made in accordance with the present invention, it will be noted that for a given movement of the adjustment members 40, the gate opening 38 moves less than in the known the cutting head. Accordingly, one can more finely adjust the gate opening 38 of the cutting head of the present invention over the known cutting head since there is greater control of the adjustment members 40 relative to the adjusted width of the gate opening 38. The ability to more precisely adjust the gate opening 38 is based solely on the position of the pivot pins 22, 24 relative to the cutting edge 19 of the cutting blade 18, which is permitted by the configuration of the elements of the cutting head of the invention.

In the preferred embodiment in FIG. 11, each of the mounting rings 12, 14 includes a plurality of arcuate slots 52 defined therethrough with each slot corresponding to one of the cutter support segments 16 attached thereto. The arcuate slots 52 are configured to receive a fastener device 20 that extends therethrough to engage the cutter support segments 16 and permit movement of the cutter support segments 16 relative to the fastener devices 20. Known fastening devices such as bolts and screws may be utilized to removably mount the upper and lower mounting rings 12, 14 to the cutter support segments 16. The size of the arcuate slots 52 are defined by the range of adjustment of the cutter support segments 16 and are configured and arranged to have a width slightly larger than an outer diameter of the fastener devices 20 so as to permit the cutter support segment 16 to pivot relative to the upper and lower mounting rings 12, 14. It will be noted that when the cutter support segments 16 are adjusted about their pivot axis, the fastener devices 20 are loosened from the upper and lower mounting rings 12, 14, and tightened when the desired gate opening 38 is obtained.

It will be readily understood that the described embodiment of the invention is exemplary only and various other features and details could be incorporated in the system described herein without departing from the spirit and scope of the invention as defined in the appended claims.

I claim:

1. A cutting head for cutting a food product on a cutting apparatus, comprising:

an upper mounting ring;

a lower mounting ring;

a plurality of cutter support segments having generally arcuate inner and outer surfaces disposed generally in a circular array defining a central portion about a central axis, each cutter support segment having an upper portion attached to the upper mounting ring, opposed forward and rear edge portions, and a lower portion attached to the lower mounting ring, each cutter support segment defining a recess at the forward edge portion thereof;

a plurality of cutting blades each having a cutting edge and an opposed rear edge, each of the cutting blades generally secured within the recess of a corresponding one of the cutter support segments, the cutting edge of each of the cutting blades extending beyond a forward edge of the corresponding cutter support segment so as to define a gate opening between the cutting edge and an adjacent cutter support segment; and first and second pivot pins extending coaxially opposed from one another from the upper and lower portions of each of the cutter support segments over at least a portion of a corresponding one of the cutting blades, each of the cutter support segments pivotally mounted on the upper and lower mounting rings about a pivot axis defined by the first and second pivot pins and pivotally movable between a range of motion defined between a first position wherein the cutting edge of the cutting blade is positioned closely adjacent a rear portion of an adjacent cutter support segment, and a second position wherein said cutting blade is disposed at an acute angle relative to the radii of the upper and lower mounting rings and generally directed towards the central portion of the circular array of cutter support segments.

2. The cutting head according to claim 1, wherein the pivot pins are located on the cutter support segments between the rear and cutting edges of the cutting blade.

3. The cutting head according to claim 1, wherein the cutting edge of the cutting blade extends a short distance relative to its width beyond the forward edge portion of the cutter support segment, the width of the cutting blade defined between the rear and cutting edges thereof.

4. The cutting head according to claim 3, wherein the distance from which the cutting blade extends beyond the forward edge portion of the cutter support segment is less than 20% of its overall width.

5. The cutting head according to claim 1, further comprising:

diametrically opposed flanges extending from the outer surface of the upper and lower portions of each of the cutter support segments at the rear edge portion thereof, each of the flanges including an adjustment pin projecting normally from the flanges; and an adjustment member for each adjustment pin having an annular groove configured to receive a portion of the adjustment pin, the adjustment member engaging a respective one of the upper and lower mounting rings and oriented at an oblique angle relative to the radius of a respective one of the upper and lower mounting rings.

6. The cutting head according to claim 5, wherein the upper and lower mounting rings include a plurality of recesses along an outer periphery thereof, each recess arranged at the oblique angle of the adjustment member and configured to receive at least a portion of the adjustment pin and the adjustment member.

7. The cutting head according to claim 1, wherein the upper and lower mounting rings include a plurality of arcuate slots defined therethrough and each corresponding to one of the cutter support segments attached to the upper and lower mounting rings, the arcuate slots configured to receive a fastener device that extends therethrough to engage the cutter support segments and permit movement of the cutter support segments relative to the fastener devices over the range of motion between the first and second pivot portions.

8. The cutting head according to claim 7, wherein the size of the arcuate slots are defined by the range of adjustment of the cutter support segments.

9. The cutting head according to claim 1, wherein the distance between an axis of the pivot pins and a rear edge of the cutter support segments is within the range of 7 to 8.5 times the distance between the pivot pin axis and the cutting edge of the cutting blade.

10. The cutting head according to claim 1, wherein the cutting edge of the cutting blade comprises a substantially straight linear edge.

11. The cutting head according to claim 1, wherein the cutting edge of the cutting blade comprises a series of curves having opposed curvatures.

12. The cutting head according to claim 11, wherein an inner wall of the cutter support segment includes a profile comprising a series of curves having opposed curvatures corresponding to the cutting edge of the cutting blade.

13. The cutting head according to claim 1, wherein the cutting edge of the cutting blade comprises a series of V-shaped grooves.

14. The cutting head according to claim 13, wherein an inner wall of the cutter support segment includes a profile comprising a series of V-shaped grooves corresponding to the cutting edge of the cutting blade.

15. The cutting head according to claim 1, further comprising inner and outer clamping members connected to a corresponding one of the cutter support segments and substantially located within the recess thereof, the clamping members securing the cutting blades to the cutter support segments.

16. The cutting head according to claim 15, wherein the outer clamping member corresponds to the outer surface of the cutter support segments and the inner clamping member corresponds to the inner surface of the cutter support segments, the outer clamping member being fully contained within the recess of the cutter support segments.

* * * * *